US006744050B1

(12) United States Patent
Hornung et al.

(10) Patent No.: US 6,744,050 B1
(45) Date of Patent: Jun. 1, 2004

(54) METHOD AND DEVICE FOR CONTROLLING PAPER DOCUMENTS OF VALUE

(75) Inventors: Heinz Hornung, Gilching (DE); Achim Philipp, Kolbemoor (DE)

(73) Assignee: Giesecke & Devrient GmbH (DE)

( * ) Notice: Subject to any disclaimer, the term of this patent is extended or adjusted under 35 U.S.C. 154(b) by 0 days.

(21) Appl. No.: 09/786,195

(22) PCT Filed: Aug. 17, 1999

(86) PCT No.: PCT/EP99/06027

§ 371 (c)(1),
(2), (4) Date: Apr. 27, 2001

(87) PCT Pub. No.: WO00/14689

PCT Pub. Date: Mar. 16, 2000

(51) Int. Cl.[7] ..... G07D 7/00
(52) U.S. Cl. ..... 250/341.1; 250/556
(58) Field of Search ..... 250/341.1, 556, 250/226

(56) References Cited

U.S. PATENT DOCUMENTS

| | | | | |
|---|---|---|---|---|
| 4,435,834 A | * | 3/1984 | Pauli et al. | 382/135 |
| 5,304,813 A | | 4/1994 | De Man | |
| 5,367,577 A | | 11/1994 | Gotaas | |
| 6,246,471 B1 | * | 6/2001 | Jung et al. | 356/73 |

FOREIGN PATENT DOCUMENTS

| | | | | |
|---|---|---|---|---|
| DE | 2037755 | * | 2/1972 | G07D/7/00 |
| DE | 19604856 | | 8/1997 | |
| EP | 0101115 | | 2/1984 | |
| EP | 0537513 | | 4/1993 | |
| GB | 1326665 | | 8/1973 | |
| GB | 2107911 | | 5/1983 | |

* cited by examiner

*Primary Examiner*—Constantine Hannaher
*Assistant Examiner*—Otilia Gabor
(74) *Attorney, Agent, or Firm*—Bacon & Thomas, PLLC

(57) ABSTRACT

A method and apparatus for testing a paper of value, in particular for condition testing of a bank note, are proposed wherein the bank note is subjected both to dark-field measurement and to bright-field measurement. From comparison of the measuring results of dark-field measurement and bright-field measurement one can make a clear statement about whether a flaw, for example a hole, tear, etc., is present in the bank note in the tested area. The bright-field and dark-field measuring devices can be formed separately with one LED array and detector array in each case. However, preferred embodiments provide for either a common LED array with two detectors or two LED arrays with a common detector. If two LED arrays are used, the dark-field radiation source is preferably formed as an IR light source and the bright-field radiation source as a red-light radiation source in order to permit authenticity testing of the paper of value to be performed as well as condition testing thereof. (FIG. 1)

23 Claims, 3 Drawing Sheets

METHOD AND DEVICE FOR CONTROLLING PAPER DOCUMENTS OF VALUE

BACKGROUND OF THE INVENTION

This invention relates to a method for testing papers of value, in particular bank notes, and to an apparatus for carrying out the method having a measuring plane, a device for translationally moving a paper of value in the measuring plane, at least one radiation source for irradiating first and second areas of the measuring plane and a detector disposed in the dark field with respect to a radiation source for detecting the radiation diffusely transmitted by a paper of value in the first irradiated area of the measuring plane.

Numerous methods and apparatuses for testing papers of value are known. The test itself can be directed to so-called authenticity features of the papers of value, on the one hand, and to the condition of the papers of value, on the other hand. In particular the latter test is applied in connection with used bank notes since they are subject to greater wear as a result of their continuous use. Depending on the nature and extent of the wear the notes are withdrawn and replaced by newly issued notes. Features used for assessing the condition of bank notes are e.g. holes, tears, missing parts, dog-ears, dirt and stains on the notes. In contrast, the notes can be tested for authenticity e.g. in terms of IR-transmitting or IR-absorbent ink prints, dimensions such as length and width, colorfastness, printed image, opacity and the like. Some apparatuses also provide for combined testing of condition and authenticity features.

GB-A-2 107 911 discloses an apparatus for testing bank notes which evaluates solely the authenticity of a note both by an optical test relating to color reflectance and IR opacity and by a length test. The note is moved along a measuring plane and scanned along three lines in order to determine IR opacity and color reflectance. Opacity measurement is done by irradiating the note with light in the infrared wave range and detecting the IR radiation transmitted through the note by means of a detector disposed "in the bright field." Bright-field measurement means that the detector is reached directly by radiation from the radiation source if no note is present, and if a note is in the measuring plane it detects the radiation transmitted through the note directly from the radiation source (bright-field measurement). For measuring color reflectance a radiation in the visible wave range is additionally directed to the surface of the note, and the radiation reflected by the note surface is detected with a reflectance sensor. The detected transmission and reflectance radiations are compared with reference values in order to test the authenticity of the note. Testing of the length of the note is likewise done by means of the IR radiation source in that the leading edge of the note is detected therewith when the note is supplied to the measuring station while the end of the note is determined by a second sensor. However, there is no condition testing of the note.

DE-A-196 04 856 discloses an apparatus and method for testing optical security features with metallically reflecting layers such as holograms and the like as to exact positioning in the note, edge form (fraying of the contour) and completeness (holes, missing parts). One thus tests the condition of said security features in bank notes returning from circulation to the bank for example. The condition test of said metallic security features is done in transmitted light, similarly to the above-described opacity test. However, bright-field measurement as described above has proved unsuitable since an opposite arrangement of radiation source and detector would lead to metrologically adverse overdriving of the detector through direct incidence of radiation in the spaces between consecutive notes. Holes in the material under measurement would have the same effect. DE-A-196 04 856 accordingly proposes dark-field measurement. In dark-field measurement the detector is aligned with the radiation source so as not to receive any direct radiation from the radiation source when no note is present, but to be reached substantially only by radiation from the radiation source when a note is present, the radiation transmitted through the note being detected. Accordingly the detector is disposed with respect to the transport plane of the note so that light passing through the bank-note paper beside the metal layer or through its being damaged (holes, abrasion in the area of folds) is only measured insofar as it is scattered by the paper. However, this method cannot determine holes or other flaws in the paper but only in the metallic coating. Furthermore, dark-field measurement is unsuitable for determining a flaw in the paper itself since the detector cannot clearly ascertain e.g. in the case of a hole whether it is an especially opaque and therefore nontransparent place in the note or in fact a hole in the note since the detector disposed in the dark field would receive no radiation either way.

EP 0 537 513 A1 describes an improved authenticity tester for bank notes which is intended to recognize even especially good forgeries. The device is accordingly elaborate and it is proposed that dark-field measurements be performed both with IR radiation and with red light, on the one hand, and reflectance measurements both with respect to the reflectance of red irradiated light and with respect to the reflectance of green irradiated light, on the other hand. The quality of authenticity testing is thus increased by a plurality of independent authenticity tests being performed. No condition testing of the note is performed with this device.

DE-PS 20 37 755 discloses an apparatus for testing vouchers which reliably tests the authenticity of bank notes containing fluorescent fibers. The note is exposed on one side to radiation exciting the fluorescent substances, and the resulting fluorescent radiation emitted by the note is detected on both sides of the note. The detectors for fluorescent radiation are disposed in the dark field with respect to the excitation radiation source so that a further detector can be disposed in the bright field on the side of the note opposite the excitation radiation source. The detector disposed in the bright field is intended to recognize the condition of the paper of value by recognizing deficient paper density, splices, tears, inaccurate interfaces, faulty watermarks and lacking security threads by the opacity of the paper. However, this also involves the problem that direct incidence of light on the detector disposed in the bright field can lead to overdriving of the detector. In particular this detector arrangement does not permit reliable differentiation between relatively transparent, e.g. thin or unprinted, paper and holes.

The aforementioned apparatuses are either fully unsuitable for condition testing of papers of value because they relate only to authenticity testing, or only partly suitable because they cannot reliably determine holes, tears, missing parts, dog-ears and the like. Dark-field measurement involves the problem of the detector failing to determine a measured value both when detecting a flaw and when detecting a very opaque area so that it is impossible to differentiate between a hole and high opacity. In bright-field measurement the detection of a hole leads to overdriving of the detector tor at least to a high measured value which cannot be reliably distinguished from a likewise high value from a very weakly opaque area of the note.

For this reason one customarily determines flaws in bank notes using a separate hole detector, usually designed as an ultrasonic sensor. This additional hole detector involves additional costs which are not justifiable in every case. Thus, a bank note testing device detecting the condition of the notes and optionally easily testable authenticity features would frequently be sufficient for use in small banks, exchange bureaus, casinos and the like.

BRIEF SUMMARY OF THE INVENTION

The problem of the present invention is therefore to propose a method and an apparatus for testing papers of value which permit reliable recognition of flaws in bank notes in an inexpensive way.

This problem is solved by a method and an apparatus according to the present invention.

According to the invention the opacity of a note is measured both in the bright and dark fields and the determined measured values are compared. Since neither bright-field measurement nor dark-field measurement taken alone permits a reliable statement about a flaw in the note, the inventive solution provides for comparison of the two values in order to recognize whether a flaw or a slightly opaque or highly opaque area of the note is involved. When a slightly opaque area of the note is detected, bright-field measurement states no meaningful value but dark-field measurement is clear. When a highly opaque area of the note is detected, however, dark-field measurement states no meaningful value but bright-field measurement is clear.

This principle constitutes a comparatively inexpensive solution in particular because the transmission measurement method (bright-field or dark-field) customarily used for testing the opacity of bank notes need not be equipped with an additional ultrasonic sensor as a hole detector, but instead a further transmission measurement (dark-field or bright-field) is effected so that one can omit for example a special evaluation unit for the ultrasonic sensor. Due to the duplication of several components, such a tester is much less expensive to produce as a mass-produced article.

The test result is exacter the better the resolving power, i.e. the smaller the distances between detected bank note areas and the higher the degree of overlap of the note areas measured in the bright field and those measured in the dark field. An optimum result is obtained when the note areas measured in the bright field and the note areas measured in the dark field are identical and the total note is tested in extremely small steps. The method can be considerably accelerated when adjacent note areas are measured alternately in the bright and dark fields. However, this only permits reliable detection of flaws in the bank note which are so great that they are detected both by bright-field measurement and by dark-field measurement.

This principle can be realized in different ways in terms of procedure and apparatus. Thus, one radiation source and one detector can be used for bright-field measurement and dark-field measurement in each case. However, a cost reduction can be obtained by using instead of one detector and radiation source for bright-field measurement and dark-field measurement in each case, i.e. instead of two detectors and two radiation sources, either only one common radiation source with two detectors or one common detector with two radiation sources.

Using one common radiation source with two detectors, there are two possibilities. Either the radiation source irradiates two separate areas of the measuring plane, the first detector being disposed in the dark field of one irradiated area and the second detector in the bright field of the other area, or the radiation source irradiates only one area of the measuring plane, the first detector being disposed in the dark field of said irradiated area and the second detector in the bright field thereof.

Using one common detector with two radiation sources, there are likewise two possibilities, since the two sources can irradiate either two different areas of the measuring plane or the same area of the plane, the sources being disposed in both cases so that the common detector is in the dark field with respect to the first source and in the bright field with respect to the second source. Furthermore, the embodiment with one common detector necessitates that bright-field and dark-field measurement be performed at separate times. This can be obtained by driving the radiation sources accordingly or, in case two different areas of the note are irradiated, by darkening the detector with respect to a certain area in each case, or by aligning the detector with a certain area in each case. It is most favorable procedurally to drive the first and second radiation sources separately. A special embodiment of the invention provides that at least one radiation source is designed as an IR radiation source. This permits simultaneous testing of the note for IR permeability since many notes are printed with special inks which either absorb IR radiation or, more frequently, are permeable to IR radiation.

The embodiment with two separate radiation sources furthermore offers the possibility of additional reflectance measurement since a reflectance receiver on the side of the radiation sources can be used to test the printed image of a note by the light, reflected by the note. Further advantages and properties of the inventive solution will become clear from the following description and reference to the figures.

DETAILED DESCRIPTION OF THE INVENTION

Figure 1:
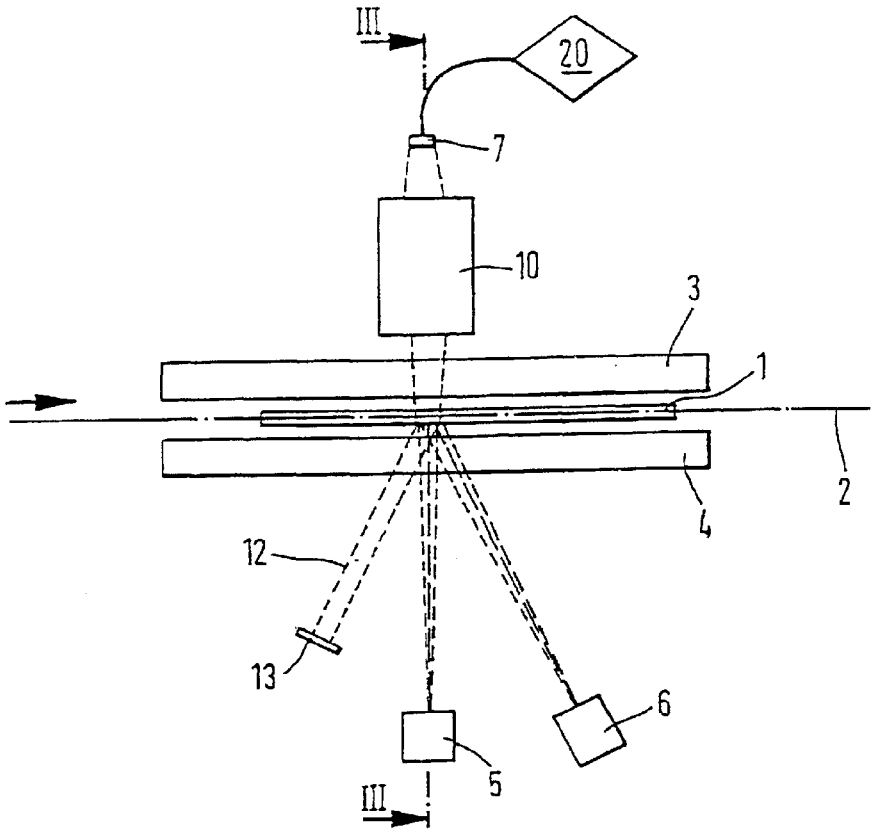
FIG. 1 shows a preferred embodiment of an inventive apparatus as a schematic diagram.
Figure 3:
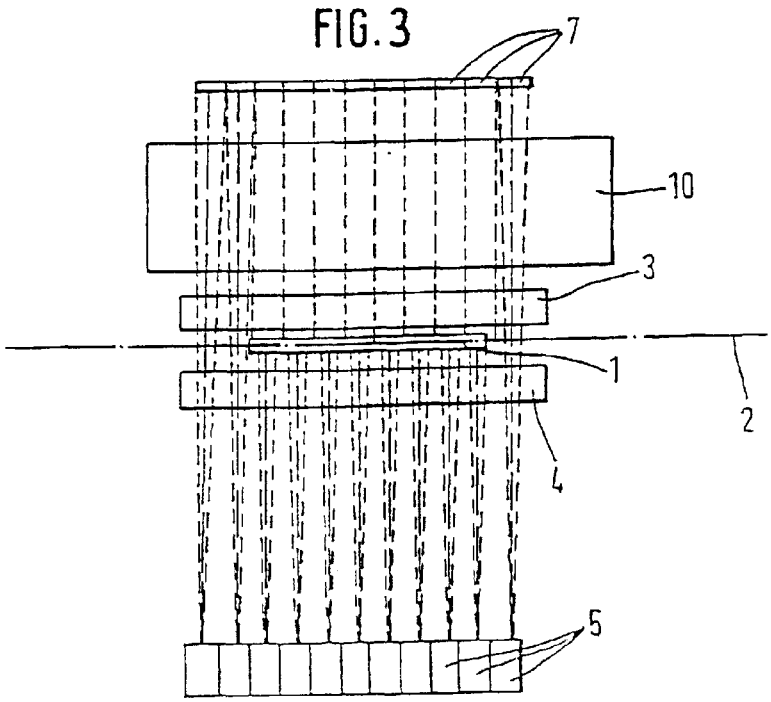
FIG. 3 shows a cross section of the apparatus of FIG. 1 along III—III.

FIGS. 1 and 3 schematically show a preferred embodiment of the present invention, FIG. 3 showing a cross section along line III—III of the apparatus shown in FIG. 1. Bank note 1 is moved along measuring plane 2 between upper window 3 and lower window 4. Below window 4 two LED arrays with LEDs 5 and 6 are so disposed that each LED irradiates the measuring plane in a defined area. The radiation paths of LEDs 5 and 6 are indicated with dashed lines. Above window 3 an array of detectors 7 is so disposed that each detector 7 is in the direct radiation range of LEDs 5. Detectors 7 are thus in the bright field with respect to LEDs 5. With respect to LEDs 6 the arrangement of detectors 7 is selected so that the detectors are not irradiated directly by LEDs 6. Detectors 7 are thus in the dark field with respect to LEDs 6. Detectors 7 are aligned so as to detect the defined areas on the bank note irradiated by opposite LEDs 5 and 6. That is, detector 7 detects radiation from directly opposite LEDs 5 transmitted through note 1 in the bright field, on the one hand, and radiation from obliquely opposite LEDs 6 transmitted through the note in the dark field, on the other hand.

Before the transmitted radiation reaches the detector it can be focused by means of simple radiation collimator 10. A simple Selfoc array may suffice. The invention can also be executed without any focusing of the transmitted radiation, however, if the transmitted radiation of the area to be tested is directed onto the detector by channeling.

Evaluation unit 20 is connected to detector 7 for evaluating the detected radiation values and determining by comparison of the values from bright-field measurement with the values from dark-field measurement whether the detected area of the note might have a flaw such as a hole, tear, etc.

Since the LED arrays and the detector array detect the total width of a note to be detected and since the note is moved between the LED arrays and the detector array along measuring plane 2, the total note can be successively tested for flaws. Comparison of bright- and dark-field measurements at the same time permits recognition of the outside contours of a note, so that the length and width of notes can be determined relatively exactly.

The resolving power depends of course on the number of measurements across the width and along the length of the note. This is especially clear in FIG. 3 where the radiation paths of LEDs 5 and detection ranges of detectors 7 are shown by dashed lines. Note 1 located in measuring plane 2 interrupts only the light path of the third (from the left) to the second last LEDs 5. Evaluation of the bright-field and dark-field measured values provided by the first and second (from the left) and last detectors 7 will therefore lead to the result "flaw" over the total length of the tested note, from which it can be inferred that the outer edges of the note are in the range of the third and second last detectors. Deviating from the view of FIG. 3, sixty detectors are preferably disposed across the width as a detector array, whereby each detector can have two sensitive pixels. The detector array can have gaps between the detectors and pixels, permitting detectors to be omitted. This affects the resolving power of the total apparatus. However, a resolution of 1 mm transversely to the transport direction may be sufficient for simple purposes.

For example, the two outer detectors of the sixty can be disposed beside the actual measuring area for bank-note testing. They can then be used e.g. to form a reference value for the brightness of the radiation emitted by the LEDs.

Preferably, the LEDs of at least one LED array radiate IR light to permit detection of authenticity features, i.e. the presence of IR-transmitting or IR-absorbent prints. Since IR-absorbent inks are used less often than IR-transmitting inks, LEDs 6, i.e. the radiation source for dark-field illumination, are preferably selected as an IR radiation source. This reduces the probability of a highly IR-absorbent printed image being evaluated as a flaw.

Advantageously, the second LED array, i.e. LEDs 5 here, radiate light in the visible wave range. By a reflectance measurement of radiation 12 reflected by the surface of a note one can additionally recognize the printed image and/or denomination of the note by means of reflectance sensor 13. Red-light LEDs are preferably used for this purpose.

Figure 2A:
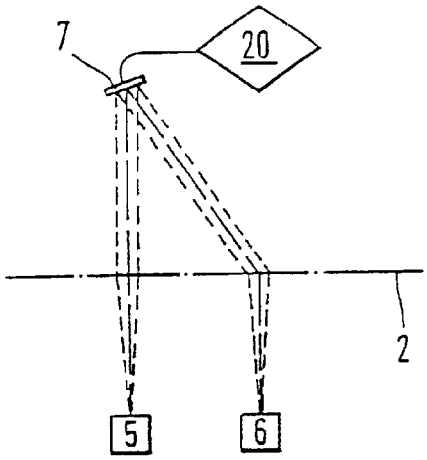
FIGS. 2*a* to 2*e* show five different embodiments of the invention as schematic diagrams.
Figure 2B:
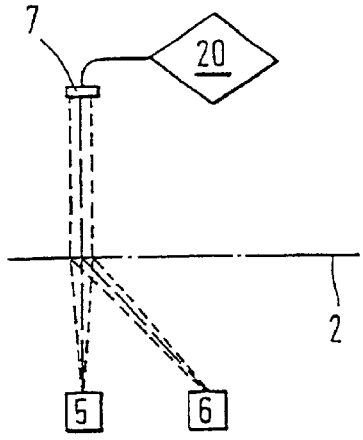

FIGS. 2*a* to 2*e* show basic embodiments of the invention described above with reference to an especially preferred embodiment. FIG. 2*b* shows the especially preferred embodiment described above with respect to FIG. 1, wherein two light sources 5 and 6 illuminate a common defined area of measuring plane 2 and have associated therewith single detector 7 disposed on the opposite side of plane 2 which detects both radiation from red-light source 5 transmitted in the bright field and IR radiation from source 6 transmitted in the dark field.

FIG. 2*a* shows a similar structure to FIG. 2*b* with two radiation sources 5 and 6 and common detector 7. However, source 6 illuminates a first area of the measuring plane and source 5 a second area of measuring plane 2, and the detector detects radiation from source 5 transmitted in the bright field and radiation from source 6 transmitted in the dark field. The first and second irradiated areas of the measuring plane can fundamentally also overlap.

The embodiments shown in FIGS. 2*a* and 2*b* presuppose, because of the use of only one detector, that detector 7 detects radiation transmitted in the bright field and radiation transmitted in the dark field independently of one other, i.e. with a time shift, so that comparison can be performed in evaluation unit 20 for ascertaining flaws of the notes with reference to the separately detected bright-field and dark-field measured values. Time-shifted detection is preferably obtained by time-shifted irradiation of the first and second areas. However, it is fundamentally also possible that the detector is shielded intermittently from the first area and intermittently from the second. Furthermore, it is conceivable that the detector is directed intermittently only onto the first area and intermittently only onto the second.

A special advantage consists in the use of two different kinds of radiation. For example the radiation sources can differ in the color spectrum, e.g. emit IR radiation and visible light.

Figure 2C:
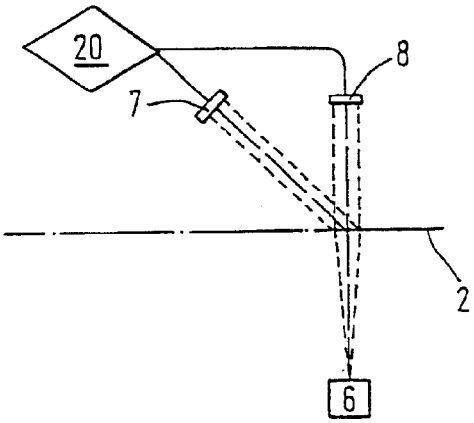
Figure 2D:
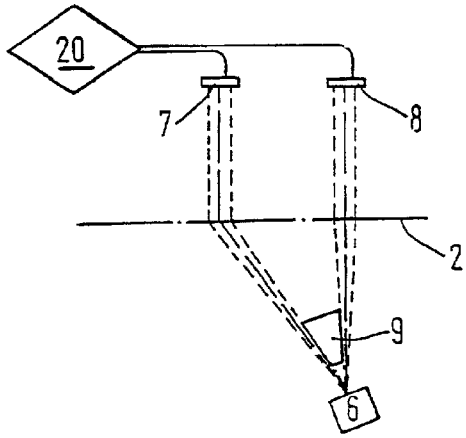

FIGS. 2*c* and 2*d* show embodiments with a reversal of the above-described principle. Instead of two radiation sources and a common detector, these embodiments provide for a common radiation source and two detectors. In FIG. 2*c* radiation source 6 illuminates a defined area of measuring plane 2 onto which both detector 7 disposed in the dark field and detector 8 disposed in the bright field are directed. In FIG. 2*d*, on the other hand, two different areas of measuring plane 2 are illuminated by radiation source 6 since e.g. the remaining radiation from source 6 is shielded by shield 9. Detector 7 is disposed in the dark field with respect to the first irradiated area while detector 8 is disposed in the bright field with respect to the second irradiated area.

The advantage of the arrangements according to FIGS. 2*c* and 2*d* with two detectors is that bright-field measurement and dark-field measurement can be performed synchronously. However, the use of radiations of different wavelengths is not possible as in the arrangements of FIGS. 2*a* and 2*b*.

For simple evaluation it is advantageous if only one area of measuring plane 2 is illuminated, as shown in FIGS. 2*b* and 2*c*, since in this case the evaluation of the measuring results of bright-field measurement and dark-field measurement of corresponding areas can be effected immediately.

Figure 2E:
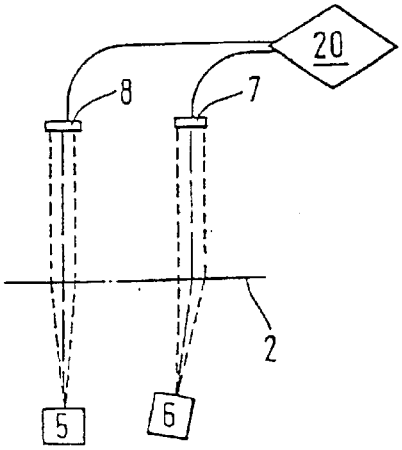

FIG. 2*e* shows a further but more elaborate and therefore less interesting embodiment of the present invention wherein first detector 7 is disposed in the dark field of first radiation source 6 and second detector 8 in the bright field of second radiation source 5. Although this embodiment is more elaborate than those described above, it offers the advantages of using two radiation sources and two detectors, i.e. synchronous measurement in the bright and dark fields and the use of different wavelengths.

The inventive method shall be described in the following. Referring to FIG. 1, note 1 is supplied along measuring plane 2 between the two windows 3 and 4 to a measuring area, i.e. the area detected with detectors 7. Each detector 7 defines its own measuring area. The leading edge of a note is then determined by means of one of the two radiation sources, preferably by dark-field measurement by means of radiation source 6 since the edge area of bank notes is usually not completely opaque so that determination of the leading edge of the note is reliably possible by means of dark-field measurement. Radiation source 5 is meanwhile turned off or shielded in order not to influence the measuring result of the dark-field measurement.

The radiation from dark-field source 6 transmitted through note 1 in a first area is detected by detector 7. After a predetermined detection time has passed, the detected radiation is read out by an evaluation unit. For readout, detector 7 is inaccessible for reception of further radiation since e.g. radiation source 6 is turned off or shielded.

After readout of the radiation transmitted from source 6 through note 1 in the first area the note is illuminated in a second area by means of source 5 while source 6 is shielded or preferably turned off. First and second areas of the note can be identical in extreme cases but also overlap—e.g. 50 percent in each case—or be completely side by side. Radiation transmitted through the note in the second area is detected by detector 7. Then the transmitted radiation detected by detector 7 in the second area is read out. This process is repeated until the total note has been detected area by area.

In the embodiment shown in FIG. 1 the second area of the note irradiated by source 5 is located in the same area of measuring plane 2 which was also illuminated by source 6. However, this does not mean that the irradiated areas of the note are identical. Only in the case of accordingly clocked feed motion of note 1 within measuring plane 2 do the note areas irradiated by source 5 coincide identically with the note areas previously irradiated by source 6. For example, the motion of the note can be effected in two stages at a time, the note being moved only between bright-field and dark-field measurements and the measured radiation read out during the note feed.

With continuous feed motion of note 1, however, the second area of note 1 irradiated by source 5 is slightly offset from the first note area illuminated by source 6. This has to do with the time sequence of irradiation and the motion of the note. Depending on the transport speed of a continuously moved note and the time control of irradiation by means of sources 5 and 6, the first areas of note 1 illuminated by source 6 and the second areas thereof illuminated by source 5 can thus overlap more or less or even be side by side. The further apart the first and second irradiated note areas are, the lower the resolution of the test apparatus will be and the greater the flaws of the note which are recognizable with the test apparatus.

Figure 4:
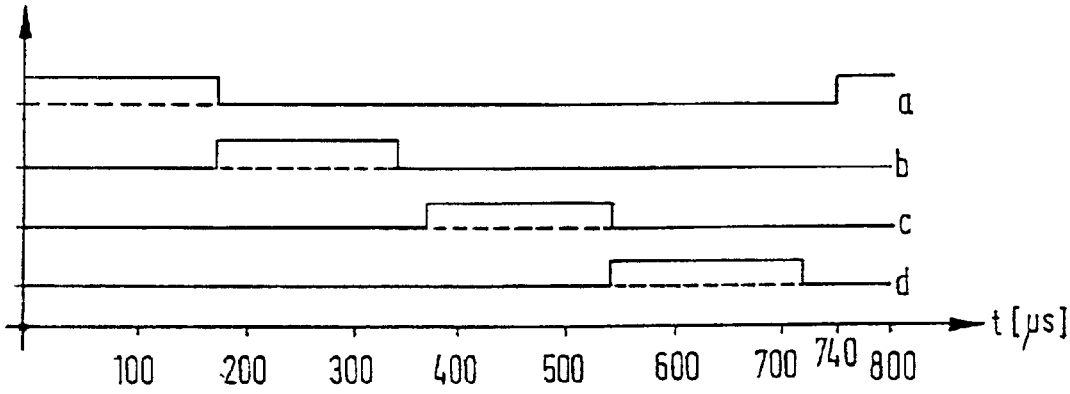
FIG. 4 shows a clock diagram for detecting a bank note and evaluating the detected results.

FIG. 4 shows by way of example a time history of the irradiation of note 1 with sources 5 and 6 and the intermediate time for reading out the detected radiation over a time axis. According to uppermost curve a the note is first irradiated for 170 $\mu$s with dark-field light source 6. After irradiation the transmitted radiation detected by detector 7 in the first area is read out for a time period of likewise 170 $\mu$s, as shown in graph b. At the end of the readout process a time gap of about 30 $\mu$s is provided before irradiation of a second area of note 1 in order to ensure that the readout of the detector is completed before new irradiation. Irradiation of the second area of note 1 by means of source 5 is likewise effected for a time period of 170 $\mu$s, as shown in graph c. This is followed by a readout of the transmitted radiation detected by detector 7 in the bright field for another 170 $\mu$s, and then by a further safety window of 30 $\mu$s. A next first area of the note is then measured in the dark field again, as indicated in curve a. A complete measuring cycle thus lasts e.g. 740 $\mu$s.

The above-described time history is especially advantageous because it permits the use of inexpensive detectors 7 which have enough time to discharge during the read time so that they are available for detecting the transmitted radiation of the next note area. More elaborate systems would obviously permit simultaneous detection, readout and adding up of the detected transmitted radiation so that the necessary time period for evaluating detected radiation could be omitted. This reduces the test time but considerably increases the equipment expense.

For the purposes of testing the condition of bank notes in circulation it has turned out that a sufficient resolution is achieved, with note 1 moved continuously in measuring plane 2 and temporally successive bright-field and dark-field measurement, when the note is moved over a transport path of 2 mm with the total cycle lasting e.g. 740 $\mu$s as shown in FIG. 4. It is evident that only a resolution of e.g. at most 2 mm is thereby reached since in the case of flaws with dimensions therebelow neither bright-field measurement nor dark-field measurement provides a clear value indicating the presence of bank-note material.

The inventive method permits reliable detection of holes, tears, missing parts, dog-ears and the like which are within the resolution range of the apparatus by comparing the transmission radiation values measured in the dark field of the first note area and in the bright field of the second note area. If the value measured in the bright field is above a given limiting value which indicates either thin unprinted paper or a flaw in the paper, it is ascertained by comparison with the value of the second area measured in the dark field that it is actually a flaw if dark-field measurement yielded a measured value near zero. If dark-field measurement yielded a relatively high value, however, this is a sign that there was actually thin unprinted paper in the measuring plane.

Evaluation of the values measured in the bright and dark fields can be effected immediately after readout of the measured values so that a statement about flaws is possible right away with reference to comparison of said values. However, the read out measured values can also be first stored temporarily and evaluated at the end of testing of the note. Besides the ascertainment of flaws, one can then simultaneously perform an authenticity comparison with reference data of standard bank notes stored in an EEPROM.

For such additional authenticity recognition, the inventive method provides as a further embodiment that one of the light sources, preferably the dark-field measurement light source, emits radiation in the IR wave range. This permits detection of images printed with IR ink. Such inks can be both permeable and absorbent for IR light while being simultaneously impermeable when illuminated with red light, so that evaluation of the detected transmitted IR radiation makes it possible to infer the authenticity of the note. The other of the two radiation sources can emit instead of IR radiation a radiation in the visible wave range, e.g. pure red light. Evaluation of the detected red radiation transmitted makes it possible to infer the printed image and the denomination. With reference to the denomination one can in turn infer the length and width dimensions of the note, so that one can perform not only a test of the IR printed image via the dimensions of the note determined with the inventive method but also a further authenticity test, i.e. the test of whether the dimensions of the tested note match the detected denomination.

By means of reflectance sensor 13 additionally provided, one can check the colorfastness, printed image and IR reflecting properties of note 1 with reference to light 12 reflected by the irradiated note area. In an evaluation unit the measured reflectance values are compared with reference values of standard bank notes.

The above-described procedure can be performed both in the basic embodiment according to FIG. 1 or 2*b* and in the embodiment according to FIG. 2*a*. The above-described method can also be performed in corresponding fashion with the embodiments of the inventive apparatus shown in FIGS. 2*c* and 2*d*, these offering the advantage of permitting simultaneous evaluation of dark-field measurement and bright-field measurement due to the use of two detectors 7 and 8. The test speed can thus be doubled since only one time segment is necessary for detecting radiation transmitted in the bright and dark fields and for reading out the detected transmitted radiation, so that the total cycle is 370 $\mu$s, including a safety window of 30 $\mu$s. However, this embodiment has the disadvantage that only one radiation can be used.

The embodiment according to FIG. 2*e* offers the procedural advantages of the basic embodiments shown in FIGS. 2*c* and 2*d*, and furthermore permits one of the two radiation sources to be designed as a source emitting visible light.

What is claimed is:

1. A method for testing a paper of value, comprising the steps of:

a) irradiating a paper of value located in a measuring plane in first and second areas, the second area being identical, in overlap or adjacent with the first area;

b) detecting the radiation transmitted through the paper of value in a bright field in the first area by means of a detector located in the direct radiation range of a radiation source;

c) detecting the radiation transmitted through the paper of value in a dark field in the second area by means of a detector located outside the direct radiation path of the radiation source;

d) repeating steps a) to c) with respect to other first and second areas of the paper of value;

e) evaluating the transmitted radiation detected in the first and second areas; and f) comparing the evaluation results from the detection of the radiation in the first and second areas and determining whether paper of value material is present in said first and second areas.

2. The method according to claim 1, wherein detection and evaluation of the radiation transmitted in the dark field are performed separately in time, and detection and evaluation of the radiation transmitted in the bright field are likewise performed separately in time.

3. The method according to claim 1, wherein the paper of value is moved translationally over a predetermined distance in the measuring plane for the total duration of detection and evaluation of the radiation transmitted in the dark field and that transmitted in the bright field.

4. The method according to claim 3, wherein the distance is about 2 mm.

5. The method according to claim 3, wherein the translational motion of the paper of value is continuous.

6. The method according to claim 3, wherein the translational motion of the paper of value is performed after irradiation of the areas.

7. The method according to claim 6, wherein evaluation of the detected radiation is performed during the translational motion of the paper of value.

8. The method according to claim 1, wherein irradiation of the first area of the paper of value is performed with a first radiation source and irradiation of the second area of the paper of value with a second radiation source.

9. The method according to claim 8, wherein detection of the radiation of the first irradiated area transmitted in the dark field and the radiation of the second irradiated area transmitted in the bright field is performed with a time shift by means of a common detector.

10. The method according to claim 9, wherein the second radiation source is directed onto the detector directly and the first radiation source is aligned obliquely thereto so as to irradiate the paper of value at an intersection point of the measuring plane with an connecting line between the detector and the second radiation source.

11. The method according to claim 8, wherein at least one of the two radiation sources is an IR light source.

12. The method according to claim 8, wherein at least one of the two radiation sources emits visible light, and light reflected by the paper of value is detected and compared with a reference value.

13. The method according to claim 1, wherein detection of the radiation transmitted in the first area is performed with a first detector and detection of the radiation transmitted in the second irradiated area with a second detector.

14. The method according to claim 13, wherein irradiation of the first and second areas of the paper of value is performed by means of a common radiation source the detection of the radiation transmitted through the paper of value in the first area and the radiation transmitted through the paper of value in the second area performed substantially synchronously.

15. The method according to claim 14, wherein the second detector is directed onto the radiation source directly and the first detector is aligned obliquely thereto so as to detect the paper of value at an intersection point of the measuring plane with a connecting line between the second detector and the radiation source.

16. An apparatus for carrying out the method according to claim 1, comprising:

a measuring plane;

a device for translationally moving a paper of value in the measuring plane;

at least one radiation source for irradiating the paper of value located in the measuring plane in first and second areas, the second area being identical, in overlap or adjacent with the first area;

at least one detector disposed in the direct radiation range for detecting the radiation transmitted from the radiation source through the paper of value in the first irradiated area of the measuring plane in the bright field, and a detector disposed outside the direct radiation output for detecting the radiation transmitted through the paper of value in the second irradiated area of the measuring plane in the dark field; and an evaluation unit connected to said detectors and arranged to evaluate the transmitted radiation detected in the first and second areas and compare the evaluation results.

17. The apparatus according to claim 16, further comprising:

a first radiation source for irradiating the first area and a second radiation source for irradiating the second area of the measuring plane;

a common detector for detecting both the radiation transmitted through the paper of value in the first irradiated area and the radiation from the second radiation source transmitted through the paper of value in the second irradiated area; and a control device for time-shifted detection of the first and second irradiated areas of the measuring plane.

18. The apparatus according to claim 17, wherein the second radiation source is directed onto the common detector directly and the first radiation source is aligned obliquely thereto so as to irradiate the measuring plane at the intersection point of the measuring plane with the connecting line between the common detector and the second radiation source.

19. The apparatus according to claim 16, wherein one of the two radiation sources is an IR light source.

20. The apparatus according to claim 19, wherein the other of the two radiation sources emits visible light, and the apparatus furthermore has a reflectance sensor for detecting light reflected by a paper of value located in the measuring plane, and an evaluation unit is provided for evaluating the detected reflected light and comparing the evaluation result with a reference value.

21. The apparatus according to claim 16, further comprising:

a common radiation source for irradiating the first and second areas of the measuring plane, and a first detector for detecting the radiation transmitted through the paper of value in the first irradiated area and a second detector for detecting the radiation transmitted through the paper of value in the second irradiated area.

22. The apparatus according to claim 21, wherein a control device is provided for time-shifted detection or irradiation of the radiation transmitted in the first irradiated area and the radiation transmitted in the second irradiated area.

23. The apparatus according to claim 22, wherein the second detector is directed onto the radiation source directly and the first detector is aligned obliquely thereto so as to detect the measuring plane at an intersection point of the measuring plane with a connecting line between the second detector and the radiation source.

* * * * *